United States Patent [19]

Da Costa

[11] Patent Number: 5,067,878

[45] Date of Patent: Nov. 26, 1991

[54] DISCHARGE FLOW BLOCKING VALVE FOR A HERMETIC ROTARY COMPRESSOR

[75] Inventor: Caio M. F. N. Da Costa, Joinville, Brazil

[73] Assignee: Empresa Brasileira de Compressores S/A - Embraco, Joinville, Brazil

[21] Appl. No.: 402,039

[22] Filed: Sep. 1, 1989

[30] Foreign Application Priority Data

Sep. 6, 1988 [BR] Brazil ..... 8804678[U]

[51] Int. Cl.[5] ..... F04B 39/00

[52] U.S. Cl. ..... 417/312; 417/279; 417/902

[58] Field of Search ..... 417/279, 312, 902

[56] References Cited

U.S. PATENT DOCUMENTS 4,573,879 3/1986 Uetuji et al. ..... 417/312

4,830,582 5/1989 Asami et al. ..... 418/312

*Primary Examiner*—Gerald A. Michalsky

*Attorney, Agent, or Firm*—Darby & Darby

[57] ABSTRACT

A discharge flow blocking valve for a compressor having a sealed housing having a cylinder and a piston for compressing refrigerant gas. A discharge muffler is within the housing and has an inlet opening communicating with the cylinder discharge volume, a first outlet opening communicating with the interior of the sealed housing, and a second outlet opening. The blocking valve has an outer casing with a first driving opening in communication with said second outlet of said discharge muffler, and a second driving opening in communication with the housing interior, an inlet in communication with the interior of the housing and an outlet in communication with a discharge mean extending through the housing. A piston movable within the valve casing has surfaces communicating with and responsive to the gas pressure at said first and second driving inlets and is responsive to a pressure differential between the gases at said first and second driving inlets when the compressor starts and the pressure of the second outlet of the muffler is greater than that in the housing interior for moving the piston to provide fluid communication between the valve casing inlet and outlet openings so that the refrigerant gas can leave the compressor, the valve piston being moved to a position to close the valve when the compressor stops and the pressure in the discharge muffler drops.

17 Claims, 2 Drawing Sheets

DISCHARGE FLOW BLOCKING VALVE FOR A HERMETIC ROTARY COMPRESSOR

BACKGROUND OF THE INVENTION

This invention relates to a hermetic high side rotary compressor and, more particularly, to a valve for blocking the discharge flow in said type of compressor which is commonly used in small refrigerating machines.

A high side rotary compressor has as an operating characteristic that each time the compressor stops there is migration of refrigerant gas fluid from the pressurized housing to the evaporator through the condenser and capillary tube of the refrigerating system. Said migration of hot fluid to the evaporator each time the compressor periodically stops causes loss in the refrigerating capacity of the system (about 12%). Thus, in addition to heating the evaporator with a hot fluid mixture, the compressor has to re-establish the normal operating cycle each time it starts, that is, re-establish the regular operation pressure and temperature levels in each unit of the refrigerating system including the compressor itself.

A normally known solution to block the discharge fluid migration from the compressor housing to the condenser of the refrigerating system is to use a piston type flow blocking valve which is connected to the suction line by a capillary and acts in the following manner. When operating, the pressure suction line acts through the capillary upon a piston having a hole on the corner, being mounted to the discharge tube and leaves the passageway open for the gas through the hole discharge. When the compressor stops, the suction pressure stops acting and a spring returns the piston to the closed position, thereby avoiding the high pressure gas flow to be supplied into the refrigerating system.

A serious drawback to the known solution is that it is difficult to seal the cooling fluid leakage in the high pressure side acting on the piston of the valve up to the suction tube through the capillary tube of the valve. Said leakages cause losses in the compressor volumetric capacity since they are directly toward the suction. Attempts to minimize leakages in said type of blocking valve have as a result complex constructions and high cost.

BRIEF DESCRIPTION OF THE INVENTION

The object of this invention is to provide a discharge flow blocking valve which does not have the disadvantages of the known mechanisms and in addition is low in cost and easy to manufacture and assemble.

The discharge flow blocking valve of the invention is applied to a hermetic rotary compressor of the type including a hermetic housing shell which houses a cylinder and rolling piston assembly mounted on a shaft driven by an electric motor. The shaft has an end supported on a main bearing which is adjacent to the cylinder which has a ga outlet opening and a gas inlet opening in communication with the cylinder discharge volume through the discharge valve. A discharge tube is arranged through the compressor housing end wall adjacent to the compression discharge muffler.

According to the invention, the blocking valve includes a casing defining an inner chamber which is provided with an outlet opening in which the inner extension of the discharge tube is received. The valve casing also has an inlet opening in communication with the compressor housing shell interior which is located between the main bearing and one of the walls or end covers of the compressor housing. The outlet opening of the discharge muffler is open to the shell interior. The valve casing also has a first driving fluid receiving opening in communication with the inner portion of the discharge muffler and a second driving fluid receiving opening in communication with the interior of the housing. A piston is housed within the valve casing so as to prevent any fluid communication between the driving inlets and at least an outlet opening. The piston is moveable between a position of valve opening, in which the fluid communication between the casing inlet and outlet openings is achieved and a valve closing position in which fluid communication is blocked between said valve casing inlet and outlet openings. The movement of the piston to the valve opening position is caused by pressure differential existing between the compressor discharge volume outlet and the compressor housing interior when the compressor starts. Movement of the piston to the valve closing position is caused by the action of other forces acting upon the piston when the compressor stops.

The blocking valve as constructed in the way above mentioned has the advantage of being driven by overpressure or by the first discharge flow of the cylinder acting upon the side of the piston faced to the compressor outlet. Any possibility of leakage of discharge gas to the suction tube does not exist, since the connecting capillary tube between the valve and the suction of the known solutions is eliminated.

The new construction also makes the valve assembly easier, since there is no need of control in the joints (for example, welds) of the parts, specially in relation to the suction tube as it occurs in the prior art.

BRIEF DESCRIPTION OF THE DRAWINGS

The invention will be hereinafter described, with reference to the attached drawings, in which.

DETAILED DESCRIPTION OF THE INVENTION

Figure 1:
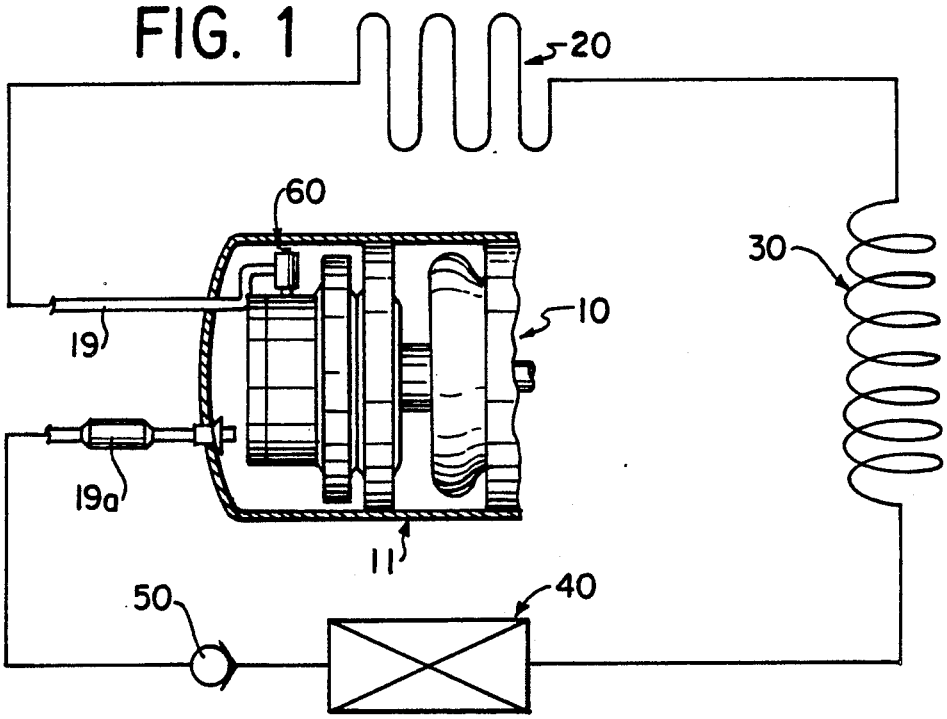
FIG. 1 is a schematic view of a refrigerating system using a blocking valve according to the invention.

As illustrated in FIG. 1, a typical refrigerating system includes a hermetic compressor 10 having a condenser 20, a capillary tube 30 and an evaporator 40. A check valve 50 is usually installed in systems using rotary compressors between compressor 10 and evaporator 40. Valve 50 operates to prevent the hot refrigerant gas from passing from the compressor housing 10 to the evaporator 40 when the system stops.

To prevent the refrigerant gas from passing from the compressor 10 to the evaporator 40 through the condenser 20 and the capillary tube 30 when the compressor stops, the system has a discharge blocking valve 60 inside the compressor housing 10.

Figure 2:
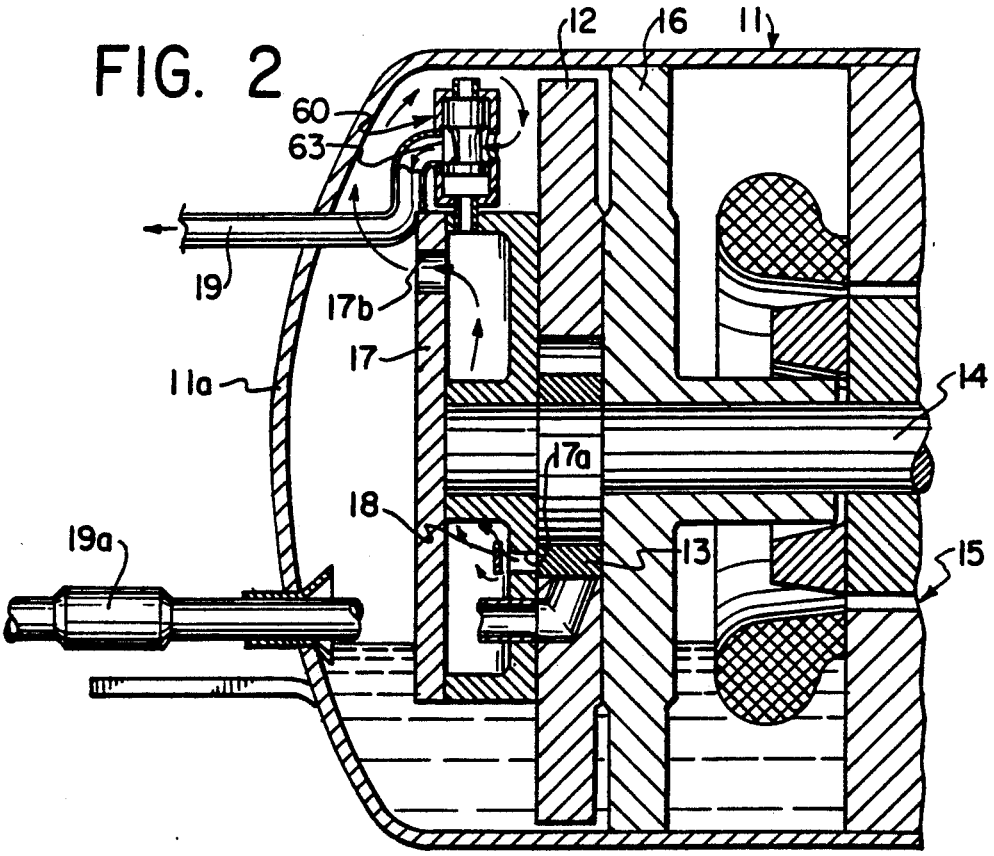
FIG. 2 shows an enlarged detail of a portion of FIG. 1, illustrating a partial longitudinal section of the hermetic rotary compressor which is provided with the blocking valve.

As better illustrated in FIG. 2, the blocking valve 60 of the invention is mounted within a hermetic rotary compressor of a type including a hermetic housing 11 which houses a cylinder assembly 12 and a rolling piston 13 mounted on a shaft 14 driven by an electric motor 15. The shaft 14 has an end supported at least on a main bearing 16 adjacent to the cylinder 12 and attached to the housing wall 11.

A discharge muffler 17 is mounted adjacent the cylinder's other wall. The muffler has a gas inlet opening 17*a* in communication with the cylinder discharge volume 12 through a discharge valve 18 and a gas outlet opening 17*b*. A discharge tube 19 and a suction tube 19*a* extend through the housing end wall 11*a* opposite the discharge muffler 17.

According to the preferred embodiment of the valve herein shown, the outlet opening 17*b* of the discharge muffler 17 is kept in direct communication with the interior of compressor housing 11 between the main bearing 16 and the housing end wall 11*a* having the discharge tube 19 and the suction tube 19*a*.

Figure 3A:
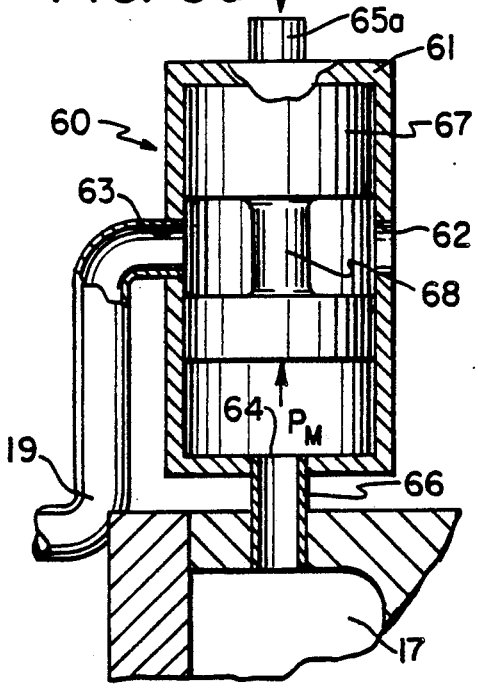
FIGS. 3*a* and 3*b* show, in enlarged scale, a longitudinal section view of the blocking valve in "open" and "closed" conditions, respectively.
Figure 3B:
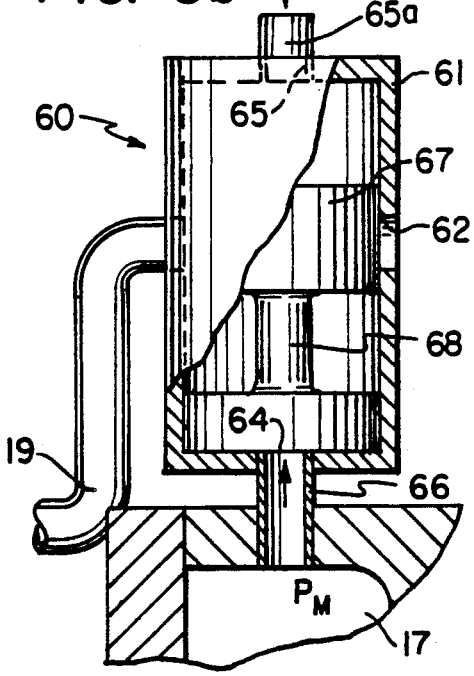

According to the embodiment illustrated in FIGS. 2, 3*a* and 3*b*, the blocking valve 60 has a cylindrical case 61 defining an inner cylindrical chamber. The case 61 has a lateral radial opening 62 for gas inlet in direct communication with the interior of the compressor housing 11 with which the outlet opening 17*b* of the discharge muffler 17 communicates. Case 11 also has a lateral radial opening 63 for gas outlet which receives the end of the curved extension of the discharge tube 19.

The valve case 61 also has a first axial opening 64 at one of the ends thereof for the gas which drives the valve. The first driving opening 64 receives the end of a small capillary tube 66 the other end of which goes through one of the walls of the discharge muffler 17. The opposite end of the valve case 61 is provided with a second gas driving axial opening 65 or pressure equalizing opening. In the embodiment of FIGS. 2, 3*a* and 3*b* the second driving opening 65 receives a small tube 65*a*.

In the chamber of the cylindrical case 61 is a cylindrical valve piston or spool 67. Piston 67 has a central portion 68 with a reduced diameter in the shape of a central axial rod. The central portion is long enough to allow that, in one of the (open) operating positions of the piston 67, (see FIG. 3*a*) both the inlet radial lateral opening 62 and the outlet radial lateral opening 63 remain in fluid communication. The open position of the valve allows the refrigerant gas to flow from the inside of the compressor housing 11 through the blocking valve 60 into the discharge tube 19 and then into the condenser 20 of the refrigerating system.

In the other (closed) valve operating position (see FIG. 3*b*), the fluid communication between the lateral inlet opening 62 and the lateral outlet opening 63 is fully blocked.

The dimension of the parts of the valve in the embodiment of FIGS. 2–3 is such that both the end axial openings 64 and 65 are not in fluid communication with the inlet 62 and outlet 63 lateral radial openings. The operation of valve 60 as illustrated in FIGS. 3*a* and 3*b* is as described below.

When the compressor 10 operates, the gas being compressed in the compressor set goes through the discharge valve 18 into the muffler 17 and therefrom through the exhaust opening 17*b* to the interior of compressor 11 through which extends the discharge tube 19 and the discharge line into the condenser 20. With this arrangement, pressure $P_M$ inside the muffler 17 will be slightly higher than the pressure $P_C$ inside the case 11. This pressure differential is used to drive the flow blocking valve 60.

Immediately after the compressor 10 starts operating, the muffler 17 pressure $P_M$ entering valve case 61 through tube 66 pushes the blocking valve piston 67 upwardly to the open position (FIG. 3*a*). In this position, the central portion 68 of the piston is in line with both radial lateral openings 62 and 63 of the housing 61 and puts these openings in fluid communication thereby opening the blocking valve. When the compressor stops operating, the discharge muffler 17 and the pressure in the interior of housing 11 are equalized (the flow stops). Therefore, the blocking valve piston 67 moves down by gravity and closes the discharge tube 19. This prevents the condenser 20 fluid migration from going into the compressor 10 through the discharge line 19.

In the embodiment shown in FIGS. 2, 3*a* and 3*b*, the piston 67 has the same area to pressures $P_M$ and $P_C$. In this case, the movement of the piston 67 to the closed valve position after the compressor stops is effected by gravity force on the piston, so the valve assembly must be maintained in a vertical position. However, it will be understood that any mechanical means can be provided which will be able to put some elastic force on the piston in order to move it to the closed valve position when there is equilibrium of pressure between the exhaust muffler chamber 17 and the interior portion of the housing 11.

Figure 4A:
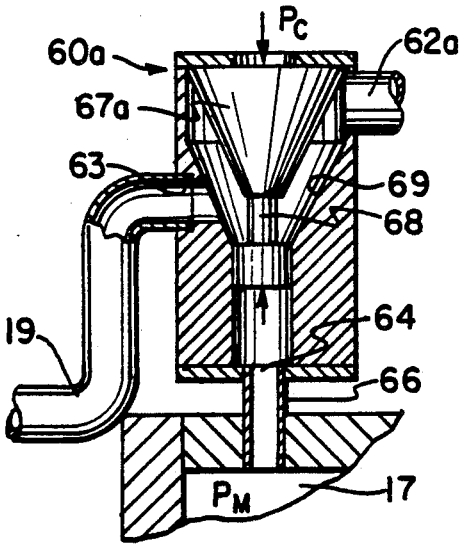
FIGS. 4*a* and 4*b* are views similar to those of FIGS. 3*a* and 3*b* illustrating a different embodiment or construction of the blocking valve.
Figure 4B:
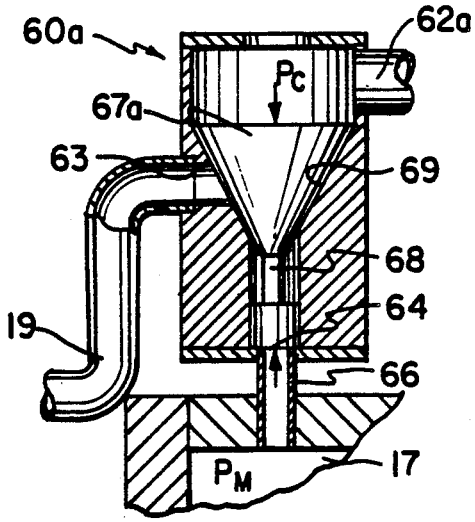

FIGS. 4*a* and 4*b* illustrate another embodiment of the blocking valve. In this embodiment, valve 60*a* has the cylindrical case thereof 61*a* defining an inner chamber with an upper cylindrical portion 68 adjacent to the ($P_C$) driving axial opening 65 and including a lateral inlet opening 62*a* in communication with this cylindrical portion. The chamber has a frustro-conical central portion 69 having the lateral radial outlet opening 63. The chamber continues with a cylindrical portion 70 of reduced diameter and having at its outer end the first axial driving opening 64.

In the embodiment of FIG. 4, the piston 67*a* is of a frustro-conical shape to seat in the frusto-conical portion 69 of the chamber when the valve is closed. The lower part of the piston is sized to move inside the chamber cylindrical portion 70 of smaller diameter so that no fluid communication occurs between the first axial driving opening 64 and the radial lateral openings 62*a* and 63 during the operation of the valve.

In the embodiment of FIGS. 4*a* and 4*b* both piston end faces 67 can be sized to have different areas so that the pressure differential between the muffler 17 chamber and the interior of compressor housing 11 in operation is enough to allow the movement of the piston to the open valve position (FIG. 4*a*) and so that the equalization of said pressures when the compressor stops results in a force upon piston 67*a* being sufficient to move it to the closed valve position (FIG. 4*b*) without taking into account the aid of the gravity force.

Although two possible embodiments are herein described and illustrated for the blocking valve, it will be understood that modifications ca be made within the inventive principle as defined by the claims.

I claim:

1. A discharge flow blocking valve for a compressor comprising:

a sealed housing, a cylinder and a piston for copressing refrigerant gas within said housing, a discharge muffler within the housing having an inlet opening communicating with the cylinder discharge volume, a first outlet communicating with the interior of the sealed housing, and a second outlet, a blocking valve in said housing having an outer casing with first driving opening for receiving gas in communication with said second outlet of said discharge muffler, and a second driving opening for receiving gas in communication with the housing interior, said valve casing also having an inlet in communication with the interior of the housing to receive the discharge gas conveyed from the discharge muffler first outlet into the interior of the sealed housing and an outlet in communication with a discharge means extending through and external to said housing, a piston movable within said valve casing having surfaces communicating with and responsive to the gas pressure at said first and second driving inlets, said piston responsive to a pressure differntial between the gases at said first and second driving inlets when the compressor starts and the pressue at the second outlet of the muffler is greate than the pressure in the compressor having interior for moving the piston to a position to provide fluid communication between said casing inlet and outlet openigns to convey the discharge gas from the sealed housing through the valve casing to the discharge means and out of the housing.

2. A discharge flow blocking valve for a compressor according to claim 1 wherein the movement of the piston to the valve closing position when the compressor stops and the pressure at the discharge muffler second outlet is reduced is effected by non-pneumatic forces.

3. A discharge flow blocking valve for a compressor according to claim 2 wherein the movement of the piston to the valve closing position is effected by gravity action when the compressor stops and the pressures at the first and second driving inlets are substantially equal.

4. A discharge flow blocking valve for a compressor according to claim 3 wherein the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

5. A discharge flow blocking valve for a compressor according to claim 2 wherein the casing of the blocking valve has a cylindrical shape which houses the piston, the first and the second driving inlets being located at the opposite ends of the casing and the inlet and outlet openings located in the casing main cylindrical wall.

6. A discharge flow blocking valve for a compressor according to claim 5, wherein the piston has a central portion of reduced diameter in line with the inlet and outlet openings when the piston moves to the valve open position.

7. A discharge flow blocking valve for a compressor according to claim 6 wherein closing of the valve is effected by the simultaneous blocking of the inlet and outlet of the casing by a cylindrical portion of the piston.

8. A discharge flow blocking valve for a compressor according to claim 5 wherein the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

9. A discharge flow blocking valve for a compressor according to claim 8 wherein the piston has a frustro-conical portion at one end, closing of the valve is effected by the blocking of the outlet in the frustro-conical portion of the casing by the frustro-conical portion of the piston.

10. A discharge flow blocking valve according to claim 9 wherein the position has a central portion of reduced diameter which is located in the frustro-conical portion of the casing when the piston moves to the valve open position and the communication between the valve inlet ad outlet opening include a path past said reduced diameter piston portion.

11. A discharge flow blocking valve for a compressor according to claim 2 where the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

12. A discharge flow blocking valve for a compressor according to claim 1 wherein the first driving inlet is connected to the discharge muffler second outlet through a capillary tube.

13. A discharge flow blocking valve for a compressor according to claim 12 wherein the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

14. A discharge flow blocking valve for a compressore according to claim 1 wherein the movement of the piston to the valve closing position is effected by the equilibrium of pressures within the discharge muffler and compressor housing interior.

15. A discharge flow blocking valve for a compressor according to claim 14 wherein the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

16. A discharge flow blocking valve for a compressor according to claim 1 wherein the valve chamber has a cylindrical portion adjacent to the second driving inlet which is at an end of the valve casing and including said inlet opening, a frustro-conical central portion having the outlet opening and a cylindrical portion of reduced diameter communicating with said first driving inlet located at the opposed end of the valve casing.

17. A discharge flow blocking valve for a compressor according to claim 16 wherein the piston has a conical portion being sealable over the outlet opening when the piston moves to the valve closing position.

* * * * *